US005915294A

United States Patent [19]

Nyberg

[11] Patent Number: 5,915,294

[45] Date of Patent: Jun. 29, 1999

[54] METHOD AND APPARATUS FOR HEATING A PAPER WEB IN A CALENDER

[75] Inventor: Timo Nyberg, Espoo, Finland

[73] Assignee: Valmet Corporation, Helsinki, Finland

[21] Appl. No.: 08/687,713

[22] Filed: Jul. 26, 1996

[30] Foreign Application Priority Data

Jul. 26, 1995 [FI] Finland ..... 953563

[51] Int. Cl.[6] ..... D21G 1/00; B30B 3/04; B30B 15/34

[52] U.S. Cl. ..... 100/38; 100/74; 100/332

[58] Field of Search ..... 100/38, 35, 73–75, 100/331, 332, FOR 103

[56] References Cited

U.S. PATENT DOCUMENTS

| | | | |
|---|---|---|---|
| 4,573,402 | 3/1986 | Sharma et al. | 100/332 |
| 4,653,395 | 3/1987 | Verkasalo . | |
| 4,658,716 | 4/1987 | Boissevain | 100/332 |
| 4,788,779 | 12/1988 | Sparkes . | |
| 5,011,709 | 4/1991 | Arbogast et al. . | |
| 5,020,469 | 6/1991 | Boissevain et al. . | |
| 5,156,086 | 10/1992 | Kiema et al. | 100/38 |
| 5,163,365 | 11/1992 | Taylor | 100/74 |
| 5,215,008 | 6/1993 | Kartovaara et al. | 100/47 |
| 5,223,099 | 6/1993 | Salo | 100/332 |
| 5,245,920 | 9/1993 | Hess . | |
| 5,318,670 | 6/1994 | Link et al. . | |
| 5,387,782 | 2/1995 | Holik . | |
| 5,392,701 | 2/1995 | Schiel . | |
| 5,404,654 | 4/1995 | Babansky et al. . | |
| 5,483,873 | 1/1996 | Koivukunnas et al. . | |
| 5,496,597 | 3/1996 | Soininen et al. . | |

FOREIGN PATENT DOCUMENTS

| | | |
|---|---|---|
| 2110786 | 7/1994 | Canada . |
| 0617165 | 9/1994 | European Pat. Off. . |
| 71374 | 12/1986 | Finland . |
| 890219 | 7/1990 | Finland . |
| 912666 | 6/1991 | Finland . |
| 923326 | 7/1992 | Finland . |
| 922456 | 11/1992 | Finland . |
| 933278 | 7/1993 | Finland . |
| 940102 | 7/1994 | Finland . |
| 943278 | 1/1995 | Finland . |
| 94068 | 7/1995 | Finland . |
| 95061 | 8/1995 | Finland . |
| 4112537 | 10/1992 | Germany . |
| 9306448 | 7/1993 | Germany . |

OTHER PUBLICATIONS

Dipl.–Ing. Bernhard Krenkel: Glattwerksuntersuchungen, Zusammenhange zwischen Glattparametern und Messgrossen, Dissertation an der Fakultat fur Maschinenwesen und Elektrotechnik der Technischen Hochschule Graz, Heidenheim, Oktober 28 1975, pp. 40–42.

*Primary Examiner*—Stephen F. Gerrity
*Attorney, Agent, or Firm*—Steinberg & Raskin, P.C.

[57] ABSTRACT

A method and apparatus for heating a paper web in a calender in which the paper web is heated before it is passed into a calendering nip of the calender. The paper web is heated by a source of radiation and the heat radiation coming from the source of radiation is condensed and guided by a reflector face or an equivalent optical device onto the paper web and/or onto a face of one of the rolls in the calendering nip substantially directly before the calendering nip.

25 Claims, 3 Drawing Sheets

METHOD AND APPARATUS FOR HEATING A PAPER WEB IN A CALENDER

FIELD OF THE INVENTION

The present invention relates to a method for heating a paper web in a calender, and more particularly to a method for heating a paper web before the web is passed into a calendering nip of the calender.

The present invention also relates to an apparatus for heating a paper web or other fibrous web in a calender before a calendering nip of the calender in order to improve the calendering of the web in the calendering nip.

BACKGROUND OF THE INVENTION

By means of the calendering of paper in connection with the manufacture of paper, attempts are made to improve the quality values of the paper, or to achieve a higher speed or a better bulk of the paper at an unchanged quality level. The plasticity (workability) of paper can be increased by raising/increasing the temperature and/or the moisture content of the paper. It has been recognized that a considerable change takes place in the plasticity of paper when the temperature of the polymers contained in the paper rises to or beyond the so-called glass transition temperature. At such temperatures, the paper is more readily workable than at temperatures below the glass transition temperature. It is also recognized that an increase in the moisture content of paper lowers the glass transition temperature.

In the art, most commonly the paper web is heated in a calender nip by means of a heatable roll, a so-called "thermo roll", and additionally possibly by means of steam treatment before the nip. The steam treatment is operative to increase the moisture content in the paper and thereby lowers the glass transition temperature. However, it is a problem that at high web running speeds, the paper web do not have enough time to be heated in the nip sufficiently and therefore a portion of the steam escapes into the environment before the calender.

Thus, when paper is calendered, the effect of calendering on the paper is highly dependent on the moisture content and temperature of the fibers contained in the paper at the time of calendering: the workability of the fibers is increased, as if with a drastic jump, when their temperature reaches the so-called glass transition temperature, which depends on the moisture content in the fibers. Above the glass transition temperature, permanent deformations are readily produced in the fibers, and below the glass transition temperature, the deformations tend to be reversible. In order to guarantee the permanence of the effects of calendering, the web can be moistened so as to lower the glass transition temperature and, moreover, it is possible to employ high calendering temperatures and high pressures, in which case the entire web readily exceeds the glass transition temperature and, thus, the deformation takes place evenly across the entire cross section (width) of the web.

From the prior art, it is generally known to heat the paper web before it is passed into the calendering nip. With respect to specific prior art, reference is made to the paper by Dipl.-Ing. Bernhard Krenkel, Glattwerksuntersuchungen, Zusammenhange zwischen Glattparametem und Messgrossen, Dissertation an der Fakultat fur Maschinenwesen und Elektrotechnik der Technischen Hochschule Graz, Heidenheim, Oct. 28, 1975, pp. 40–42, in which preheating of paper before the calendering nip is mentioned so as to improve the calendering result. In this paper, as an example of a possible mode of preheating, a method is mentioned in which the web is made to run along the face of a hot roll before it is passed into the calendering nip.

From German Utility Model Publication No. DE 93 06 448.9, a device is known in which attempts have been made to apply the method described above in practice. In this device, the wrap angle of the web around the hot roll can be regulated. In this prior art method, a problem is the weakness of the contact between the paper web and the roll before the calendering nip, in which case, in reality, the web does not receive a sufficiently rapid preheating.

Another prior art method is described in German Patent Publication No. DE 41 12 537 (which corresponds to U.S. Pat. No. 5,387,782 incorporated by reference herein), in which the web is heated by means of a dielectric electric field before the paper web is passed into the nip. A drawback of this prior art method is the size of the heating device and, because of the size, the significant distance it must be positioned from the nip. In light of this significant distance, the web has time to cool down partially between the heating device and the calendering nip and, moreover, the web has time to deliver (e.g., transfer through evaporation) a considerable part of its moisture to the surrounding air.

Further, with respect to the prior art, reference is made to published Finnish Patent Application No. 923326 (which corresponds to German Patent Publication No. DE 41 26 233 and U.S. Pat. No. 5,318,670 incorporated by reference herein), in which a separate paper web heating device is described. The device is operative before the web is calendered in a nip which is formed by two rolls that are cooled. In this method, the paper web is first heated by means of heat radiators so that the plasticizing temperature is reached on the faces of the paper web, after which the paper web is passed through the pair of rolls that form or define the nip in which the paper web is pressed and cooled. This prior art method has the drawback that the web has time to be partially cooled before the calendering nip and also, is able to deliver a considerable part of its moisture to the surrounding air (e.g., through evaporation).

In published Finnish Patent Application No. 940102 (which corresponds to German Patent Publication No. DE 43 01 023 and Canadian Patent Application No. 2,110,786), a method is described for heating the paper web before it is passed into the calendering nip. In this method, attempts are made to condense steam into the paper web by means of a steam box, which steam delivers the necessary heat to the surface layers of the paper when it is condensed. In this prior art construction, it has been realized that the heating/moistening of the paper web must be carried out as close to the nip as possible in order that the favorable calendering condition produced in the paper is not discharged before the nip. Also in this prior art method, the paper web is, at the same time, moistened and heated before the web is passed into the hot calendering nip.

Reference is also made to published Finnish Patent Application No. 943278 (which corresponds to German Patent No. DE 43 22 876 and Canadian Patent Application No. 2,127,767, in which an arrangement is described having a thermo roll heated by means of an infrared heater.

In general, it is known that in order for the paper web to be worked efficiently, its temperature must be higher than its glass transition temperature, which is about 120° C. to about 150° C. In prior art arrangements, the heat is introduced to the paper web through a hot roll that is in contact with the paper. Other prior art arrangements for heating the paper web include hot-air, steam and infrared heaters. With the use of an infrared device for heating the surface of the paper, it has, however, proven to be a problem that the paper web has become dry before it enters into the nip, and the calendering result has not been improved at all. In the prior art arrangements applying infrared heaters, the reason for drying before the nip has been the long distance between the heating point and the calendering nip.

In a manner in itself known, the paper web can also be coated with a coating which consists of pigment, binder agent, and additives. By means of the coating of the paper web, attempts are made, among other things, to provide the paper with increased whiteness, smoothness and glaze/matt (matted) finish. By means of calendering, all of the above properties are effected. Paper comprises cellulose, hemicellulose and lignin, and coating agents that are used include, among other things, aluminosilicate, calcium carbonate, titanium oxide, and talc, in which binder agents that are used are latexes such as, for example, styrene butadiene and acrylates. The capacity of infrared absorption of all of these agents varies.

Also from the prior art, various elliptic reflectors are known and are used in connection with electrically operated infrared devices. As is well known, such devices are employed in the plastics industry, and by using different coatings of the reflectors, it is possible to produce different reflecting faces. For example, short-wave thermal energy of the sun can be passed in through a glass pane, but the passage of long-wave radiation from the interior outward can be prevented by reflecting it back toward the interior (selective glass). Part of infrared radiation complies with the rules of reflection of visible light.

OBJECTS AND SUMMARY OF THE INVENTION

It is an object of the present invention to provide a method and apparatus for heating a paper web in a calender, in which the problems described above are not encountered, which problems arise mainly from drying of the paper before the calendering nip.

It is another object of the present invention to provide a new and improved method and apparatus for heating a paper web before a calendering nip of a calender.

In view of achieving the objects stated above and others, in the method in accordance with the present invention, a paper web is heated by the intermediate of a source of radiation whereby the heat radiation coming from the source of radiation is condensed and guided, or otherwise focused or directed, by a reflector face or an equivalent optical device onto the paper web and/or onto the face of one of the rolls in the calendering nip at a location substantially directly before the calendering nip. By the term "substantially directly before the calendering nip", it is meant that the paper web does not have a significant distance over which heat is not applied between the application location of the heat and the calendering nip so that the paper web does not cool down, i.e., lose heat, between the application location of the heat and the calendering nip.

In the present invention and in different embodiments of same, it has been successfully possible to combine certain component constructions in a novel and inventive manner. Some of these constructions are in themselves known from the paper machine technology so that the problems of different natures discussed above have been brought under control and solved by means of a novel overall concept.

In the method in accordance with the present invention, it has been realized that the paper can be brought, at a favorable state of moisture and almost at a temperature of equilibrium, right to the vicinity of the nip, where it is subjected to a highly intensive, focused energy flow. This energy flow raises the temperature of the paper within a very short period of time to a level suitable for calendering so that the moisture content in the paper does not have time to be lowered before the nip proper (i.e., as a result of evaporation of moisture from the web caused by any lengthy distance between the point of application of the heat and the calendering nip).

It is one of the advantages of the invention that the heating device proper does not have to be positioned in the highly inconvenient gap between two rolls but, as the energy is transferred as radiation, it can be directed, e.g., by means of an actuator placed at a considerably greater distance from the nip, at an area that is placed even right at the side of the nip area. Another advantage is that by means of the radiation energy, it is possible to heat both the face of the thermo roll and the paper at the same time.

The method in accordance with the invention differs particularly favorably from the prior art constructions in that, in view of the temperature raising point (the point at which the temperature of the paper is raised by the application of heat) and the distance of the raising point from the nip, a situation is reached in which the moisture content in the paper does not have a lot of time to be lowered and the paper is not dried.

It is a further advantage of the invention that, by means of the method in accordance with the invention, the heating energy can be applied alternatively only to the paper or only to the roll or even at the same time both to the paper and to the roll.

In the method in accordance with the invention, the thermal capacity, which is produced, for example, by means of an electric infrared device, is focused or guided by means of optical devices into the nip and/or to the vicinity of the nip. The thermal radiation can impinge on the roll right before the nip, from which roll it is either reflected to the paper and/or is transferred on the roll face as heat into the nip and further to the paper.

When the present invention is applied, as the coating agent for the paper, it is possible to use an agent that absorbs infrared radiation (the coating of the paper being performed prior to the calendering nip and thus the heating of the web being enhanced by the presence of the infrared radiation absorbing coating). Alternatively, an uncoated web can be passed through the calendering nip to be calendered.

The apparatus for heating a paper web before the paper web is passed into a calendering nip of a calender in accordance with the invention comprises a source for emitting radiation and focusing means for focusing emitted radiation from the source of radiation onto the paper web and/or a face of one of a pair of rolls defining the calendering nip substantially directly before the calendering nip. The focusing means may comprise a reflector face arranged in a path of the emitted radiation to reflect the emitted radiation toward the calendering nip. To prevent the web from drying out as a result of the application of the radiation, the apparatus may also include means for directing a moisture affecting fluid such as steam into an area defined between the paper web and the calender roll to affect the moisture content of the paper web before the paper web is passed into the calendering nip. In one embodiment, the source of radiation is an infrared radiator which emits thermal radiation and the focusing means comprise a reflector face having an elliptic or parabolic reflecting surface in a path of the emitted thermal radiation such that the reflecting surface reflects the emitted thermal radiation from the source of radiation onto the paper web and/or the face of the roll defining the calendering nip. The parabolic reflecting surface is oriented toward the calendering nip and the source of radiation is arranged within an interior region defined by the parabolic reflecting surface. If the parabolic reflecting surface encircles about 270° around the source of radiation, then about 75% of the emitted radiation is reflected by the parabolic surface toward the calendering nip and about 80% of the total emitted radiation from the source of radiation impinges against the paper web or the roll within a distance of about 150 mm from the calendering nip.

BRIEF DESCRIPTION OF THE DRAWINGS

In the following, the invention will be described in more detail with reference to the figures in the accompanying drawing, wherein.

DETAILED DESCRIPTION OF THE INVENTION

Figure 1:
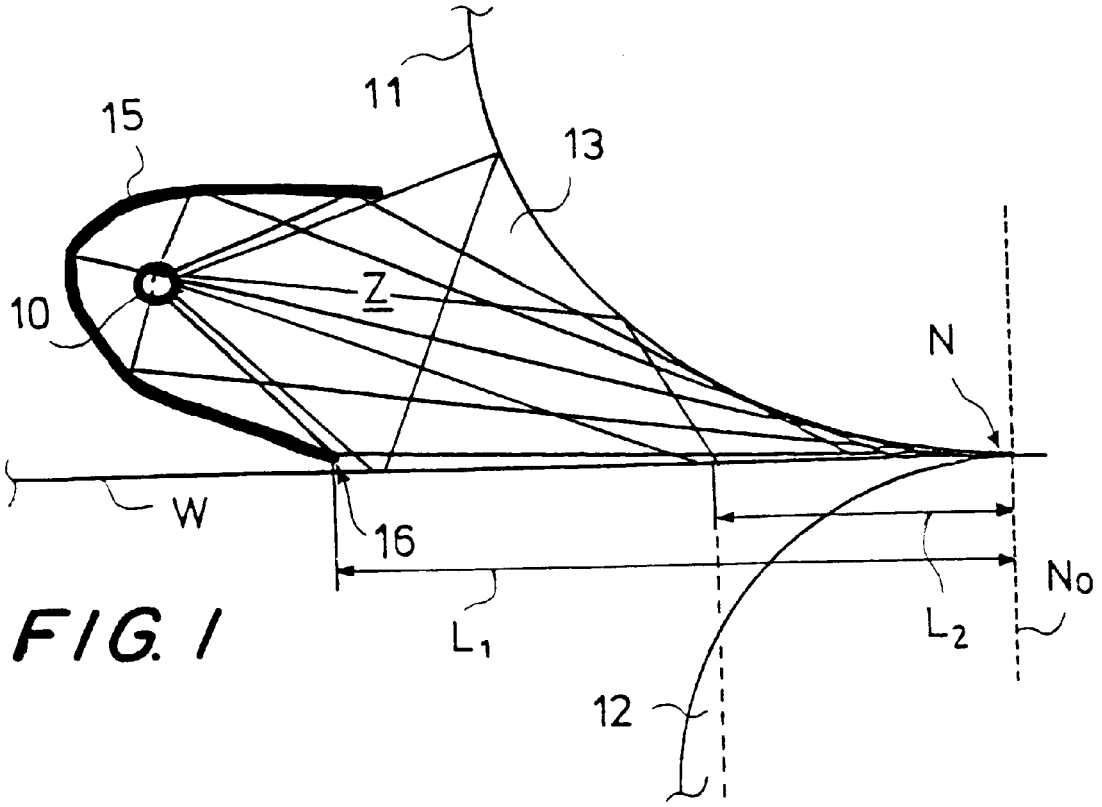
FIG. 1 is a schematic illustration of an arrangement for carrying out the method and apparatus in accordance with the present invention.

Referring to the accompanying drawings, as shown in FIG. 1, a source of radiation 10 is placed in a middle area of a reflector face 15, whose shape is preferably elliptic or parabolic, so that thermal radiation Z from the source of radiation is guided and focused from the reflector face toward a nip N formed by a pair of calendering rolls 11, 12. A paper web W runs into the nip N, in which connection it is subjected to the thermal radiation Z guided from the source of radiation 10 via the reflector face 15, which thermal radiation Z can also be guided to the paper web W through the upper roll 11, and/or which thermal radiation Z can be guided onto the upper roll 11 so that the upper roll 11 is also heated. The reflector face 15 can be mounted to any existing or dedicated structure and oriented so that its inner (with respect to the source of radiation) parabolic or elliptic reflecting surface faces the calendering nip. Also, the source of radiation 10 can be in any shape or form, including the illustrated form whereby radiation is generated in all directions therefrom.

Figure 3:
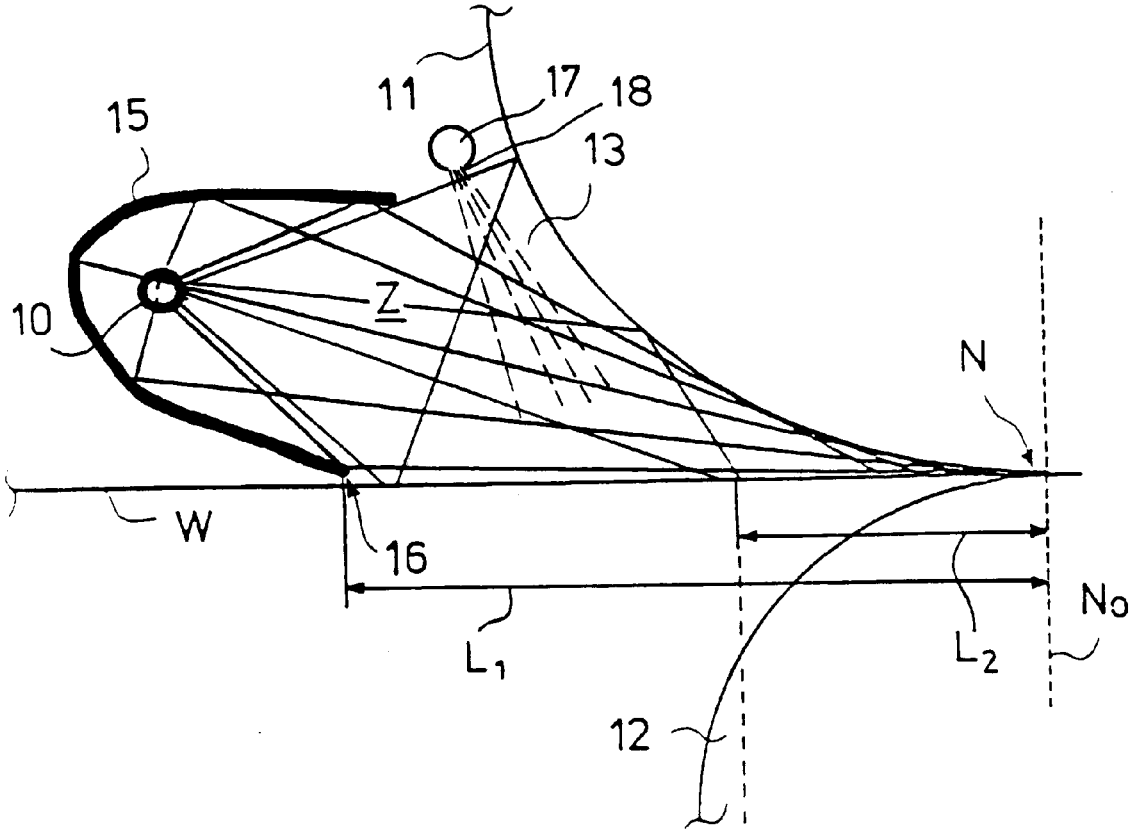
FIG. 3 is a schematic illustration of an arrangement for carrying out the method and apparatus in accordance with the invention including means for directing a moisture affecting medium into the area of the radiation.

In a preferred exemplifying embodiment of the invention, a moisture affecting fluid such as steam is passed to the area of radiation of the source of radiation between the paper web W and the upper roll 11, i.e., to an area 13, which steam moistens the web and prevents drying of the paper web W. Hot steam is also carried into the nip N along with the upper roll 11. The steam to be directed into area 13 can be produced by any conventional device 17 as as shown in FIG. 3. The steam (or other moisture affecting medium) is directed from device 17, e.g., as streams 18, into the area 13.

Figure 2:
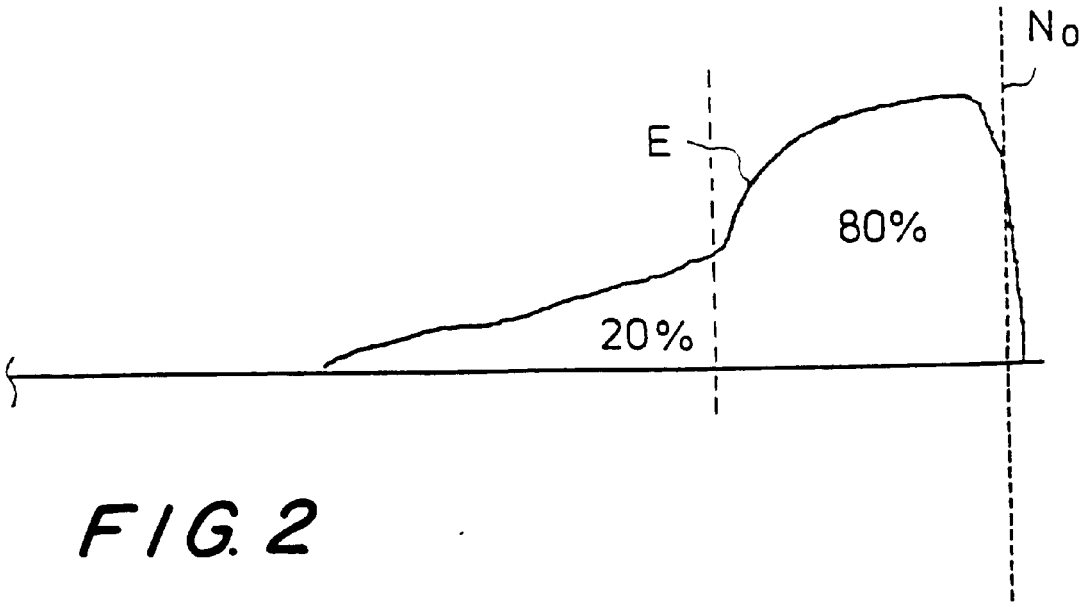
FIG. 2 illustrates the amount of heat transferred from the heating device to the web.

FIG. 2 is a schematic illustration of an amount E of heat transferred from the infrared heater (comprising source of radiation 10 and reflector face 15) to the web W, which amount E is at its maximum value right before the point at the front edge $N_o$ of the nip N. By means of an infrared heater, a high efficiency is achieved which depends on the basis weight of the paper, and the efficiency is about 35% to about 40%. It is also seen that heat is applied to the web continually from the edge of the reflector face 15 to the calendering nip.

From the schematic exemplifying embodiment illustrated in FIGS. 1 and 2, it is seen that the thermal radiation Z is guided by means of a suitable reflector face 15 to the vicinity of the nip N. As the parabolic reflector face 15 encircles about 270° of the source of radiation, the proportion of the radiation that passes directly outward (without impinging against the reflector face 15) becomes ¼ of the total radiation (90°/360°). If the distance $L_1$ of a lower edge 16 of the reflector 15 from the nip N is about 400 mm, about 20% of the radiation that passes directly outward meets the paper web W either directly or is reflected via the roll 11 onto the paper web W within a distance $L_2$ less than about 150 mm from the nip N. The remaining 80% of the radiation passing directly outwards either meets the roll 11 near the reflector face 15 and is absorbed into the roll 11 or is reflected further onto the paper web W, or the radiation meets the paper web W directly. The proportion of this energy which does not meet the web at a distance shorter than 150 mm from the nip is ¼·80% of the total radiation, i.e., only about 20%. As such, about 80% of the radiation energy meets the web within a distance of abut 150 mm before the calendering nip.

The invention is suitable for all calendering methods in themselves known, such as soft calenders, supercalenders and machine stacks, and by means of the method in accordance with the invention, the paper web can be heated to the desired temperature right before the calendering nip. If necessary or desired, in a preferred exemplifying embodiment, in order to prevent drying of the paper, extra steam can also be passed into the nip.

Figure 4:
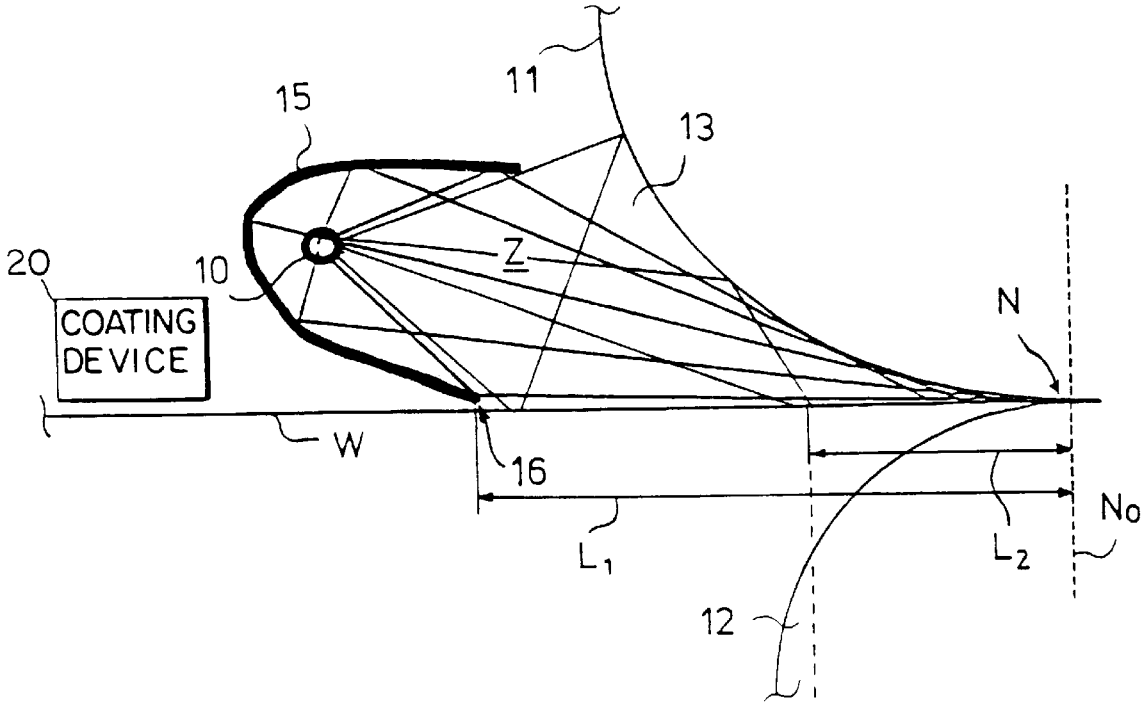
FIG. 4 is a schematic illustration of an arrangement for carrying out the method and apparatus in accordance with the invention wherein the paper web is coated by a coating device arranged before the calendering nip.

FIG. 4 shows an embodiment wherein a coating device 20 is arranged to coat the web at a location before the calendering nip N. Coating device 20 may be arranged to apply a coating agent that absorbs radiation, such as infrared radiation, such that the subsequent heating of the web is enhanced by the presence of the coating agent, and may be any device or arrangement that applies a coating to the web.

The examples provided above are not meant to be exclusive. Many other variations of the present invention would be obvious to those skilled in the art, and are contemplated to be within the scope of the appended claims.

I claim:

1. A method for heating a paper web before the paper web is passed into a calendering nip of a calender defined by first and second rolls, comprising the steps of:

providing a source of radiation, and directing emitted radiation from the source of radiation onto both the paper web and a face of the first roll at locations substantially directly before the calendering nip.

2. The method of claim 1, wherein the step of directing the emitted radiation comprises the step of focusing the emitted radiation from the source of radiation by means of an optical device toward the calendering nip.

3. The method of claim 2, wherein the optical device is a reflector face arranged in a path of the emitted radiation from the source of radiation to reflect the emitted radiation toward the calendering nip.

4. The method of claim 2, further comprising the step of arranging the optical device in a path of the emitted radiation from the source of radiation, at least a part of the optical device being arranged in a direction opposite to the direction from the source of radiation to the calendering nip.

5. The method of claim 1, further comprising the step of directing a moisture affecting fluid into an area defined between the paper web and the first roll to affect the moisture content of the paper web before the paper web is passed into the calendering nip and prevent drying of the paper web.

6. The method of claim 1, further comprising the step of directing steam into an area defined between the paper web and the first roll to affect the moisture content of the paper web before the paper web is passed into the calendering nip and prevent drying of the paper web before the calendering nip.

7. The method of claim 1, wherein the source of radiation is an infrared radiator which emits thermal radiation.

8. The method of claim 7, wherein the step of directing the emitted radiation comprises the step of focusing the emitted radiation from the source of radiation by means of an optical device toward the calendering nip, the optical device being a reflector face having an elliptic reflecting surface arranged in a path of the emitted thermal radiation such that the reflecting surface reflects the emitted thermal radiation from the source of radiation onto the paper web and said face of the first roll.

9. The method of claim 1, further comprising the step of coating the paper web before the calendering nip with a coating agent that absorbs infrared radiation.

10. The method of claim 1, wherein the paper web is uncoated before the calendering nip.

11. The method of claim 1, wherein the radiation directing step comprises the step of arranging the source of radiation within a region defined by an inner parabolic reflecting surface of a reflector face oriented toward the calendering nip.

12. The method of claim 11, wherein said inner parabolic reflecting surface encircles 270° around the source of radiation such that 75% of the emitted radiation is reflected by said inner parabolic reflecting surface toward the calendering nip.

13. The method of claim 11, further comprising the step of arranging said reflector face such that about 80% of the total emitted radiation from the source of radiation impinges against the paper web and said face of the first roll within a distance of about 150 mm from the calendering nip.

14. An apparatus for heating a paper web before the paper web is passed into a calendering nip of a calender defined by first and second rolls, comprising a source of radiation, directing means for directing emitted radiation from the source of radiation onto at least one of the paper web and a face of the first roll at a location substantially directly before the calendering nip, and means for directing a moisture affecting fluid into an area defined between the paper web and the first roll to affect the moisture content of the paper web before the paper web is passed into the calendering nip and prevent driving of the paper web.

15. The apparatus of claim 14, wherein said directing means comprise a reflector face arranged in a path of the emitted radiation to reflect the emitted radiation toward the calendering nip.

16. The apparatus of claim 14, wherein said source of radiation is an infrared radiator which emits thermal radiation, said directing means comprising a reflector face having an elliptic reflecting surface arranged in a path of the emitted thermal radiation such that the reflecting surface reflects the emitted thermal radiation from the source of radiation onto said at least one of the paper web and said face of the first roll.

17. The apparatus of claim 14, wherein said directing means comprise a reflector face having an inner parabolic reflecting surface oriented toward the calendering nip, the source of radiation being arranged within a region defined by said inner parabolic reflecting surface.

18. The apparatus of claim 17, wherein said inner parabolic reflecting surface encircles 270° around the source of radiation such that 75% of the emitted radiation is reflected by said inner parabolic surface toward the calendering nip, said reflector face being arranged such that about 80% of the total emitted radiation from the source of radiation impinges against the paper web or the first roll within a distance of about 150 mm from the calendering nip.

19. A method for heating a paper web before the paper web is passed into a calendering nip of a calender, comprising the steps of:

providing a source of radiation, directing emitted radiation from the source of radiation onto at least one of the paper web and a face of one of a pair of rolls defining the calendering nip substantially directly before the calendering nip to heat the paper web before the calendering nip, and directing a moisture affecting medium into a space defined between the paper web and said one of said rolls to affect the moisture content of the paper web before the paper web is passed into the calendering nip and prevent drying of the paper web.

20. The method of claim 19, wherein the moisture affecting medium is steam.

21. A method for heating a paper web before the paper web is passed into a calendering nip of a calender, comprising the steps of:

providing a source of radiation, directing emitted radiation from the source of radiation onto at least one of the paper web and a face of one of a pair of rolls defining the calendering nip substantially directly before the calendering nip to heat the paper web before the calendering nip, and coating the paper web before the calendering nip with a coating agent that absorbs infrared radiation.

22. A method for heating a paper web before the paper web is passed into a calendering nip of a calender, comprising the steps of:

providing a source of radiation, and directing emitted radiation from the source of radiation onto at least one of the paper web and a face of one of a pair of rolls defining the calendering nip substantially directly before the calendering nip to heat the paper web before the calendering nip, the radiation focusing step comprising the step of arranging the source of radiation within a region defined by an inner parabolic reflecting surface of a reflector face oriented toward the calendering nip, said inner parabolic reflecting surface encircling about 270° around the source of radiation such that about 75% of the emitted radiation is reflected by said inner parabolic reflecting surface toward the calendering nip.

23. A method for heating a paper web before the paper web is passed into a calendering nip of a calender, comprising the steps of:

providing a source of radiation, directing emitted radiation from the source of radiation onto at least one of the paper web and a face of one of a pair of rolls defining the calendering nip substantially directly before the calendering nip to heat the paper web before the calendering nip, the radiation focusing step comprising the step of arranging the source of radiation within a region defined by an inner parabolic reflecting surface of a reflector face oriented toward the calendering nip, and arranging said reflector face such that about 80% of the total emitted radiation from the source of radiation impinges against the paper web or said face of said one of said rolls defining the calendering nip within a distance of about 150 mm from the calendering nip.

24. A method for heating a paper web before the paper web is passed into a calendering nip of a calender, comprising the steps of:

providing a source of radiation, directing emitted radiation from the source of radiation by means of an optical device onto both the paper web and an exposed face of one of a pair of rolls defining the calendering nip at locations substantially directly before the calendering nip to heat the paper web before the calendering nip.

25. In a method for heating a paper web before the paper web is passed into a calendering nip of a calender defined by first and second rolls, the paper web being separated from an exposed face of the first and second rolls immediately before the calendering nip and defining a space between the paper web and the first roll before the calendering nip, comprising the steps of:

providing a source of radiation, and focusing emitted radiation from the source of radiation by means of an optical device through directing means for directing emitted radiation fromt the source of radiation onto a least one of the paper web and a face of the first roll at a location substantially directly before the calendering nip.

* * * * *